US005346081A

United States Patent [19]

Lin

[11] Patent Number: 5,346,081

[45] Date of Patent: Sep. 13, 1994

[54] KETTLE WITH UPWARD BOUNDING COVER AND AUTOMATICALLY EXTENSIBLE SUCKER

[75] Inventor: Bang H. Lin, Tainan, Taiwan

[73] Assignee: Shing Hong Industrial Co., Ltd., Taiwan

[21] Appl. No.: 186,640

[22] Filed: Jan. 26, 1994

[51] Int. Cl.[5] ..... B65D 51/18

[52] U.S. Cl. ..... 215/229; 220/254; 220/324; 220/326; 220/338; 220/708; 220/709; 220/714; 222/529; 222/530

[58] Field of Search ..... 215/1 A, 229; 220/254, 220/259, 263, 264, 324, 326, 338, 705, 707, 708, 709, 714, 715; 222/527, 528, 529, 530

[56] References Cited

U.S. PATENT DOCUMENTS 5,203,468 4/1993 Hsu ..... 220/254

5,282,541 2/1994 Chen ..... 215/229

*Primary Examiner*—Allan N. Shoap

*Assistant Examiner*—Nova Stucker

*Attorney, Agent, or Firm*—Beveridge, DeGrandi, Weilacher & Young

[57] ABSTRACT

A kettle includes a kettle body, a kettle cap screwed on the kettle body, a cover member covering the kettle cap, and a sucker inserted through a hole in the kettle cap. One end of the kettle cap includes a pivot support seat onto which a resilient member is connected. A pressing board is fit onto the cover member and is engaged with the resilient member. The other end of the pressing board is formed with an engaging hook section which fits into a depression formed in the kettle cap. The pressing board simultaneously presses and folds the sucker to close flow therethrough. A prying member is pivotally disposed in the kettle cap. The front edge of the prying member has a trigger section located under the engaging hook section, whereby by pressing the prying member, the trigger section is able to move and separate the hook section from an engaging recess to uplift the pressing board and cover member.

6 Claims, 8 Drawing Sheets

KETTLE WITH UPWARD BOUNDING COVER AND AUTOMATICALLY EXTENSIBLE SUCKER

BACKGROUND OF THE INVENTION

The present invention relates to a kettle having an upward bounding cover member and an automatically extensible sucker, and more particularly to a kettle which has new structure and can be conveniently used.

A conventional kettle is used in such a manner that the kettle cap is first opened and then the beverage contained in the kettle is poured into the kettle cap or a cup for drinking. Such procedure is easy to an adult or a big child. However, to a little child, it is uneasy to drink the beverage without spilling the same from the cup. Therefore, when going out, a straw must be carried to be placed in the cup for the child to suck the beverage so as to avoid spilling of the beverage. However, a user often forgets to bring the straw and the straw is liable to miss or drop onto the ground during use.

For solving the above problem, a rotary kettle with automatically extensible sucker is developed. FIGS. 1 and 2 show such kettle which includes a kettle body 1, a kettle cap 2, an upper and a lower suckers 3 and 4 and a rotary member 5. The kettle body 1 is a hollow cylindric member for containing beverage such as juice, water, etc. An upper open end of the kettle body 1 is formed with outer thread 14.

The kettle cap 2 is screwed on the outer thread 14 of the kettle body 1. An upper and a lower disk members 21, 22 with different diameters are formed on a top surface of the kettle cap 2. The upper disk member 21 is formed with an annular groove 23 and two symmetrically disposed cuts 211. The kettle cap 2 is formed with a through hole 25 for the suckers 3, 4 to extend therethrough, permitting a user to suck the beverage contained in the kettle body by means of the suckers 3 and 4.

The rotary member 5 is disposed above the kettle cap 2, having an open end 51. Two symmetrically disposed projections 52 are formed on inner edge of the open end 51 of the rotary member 5 corresponding to the cuts 211 of the kettle cap 2. An upper wall of the rotary member 5 is formed with a slot 53 for the upper sucker 3 to extend therethrough.

According to the above arrangements, when the projections 52 of the rotary member 5 are aligned with the cuts 211 of the kettle cap 2, the rotary member 5 can be fitted with the kettle cap 2. The rotary member 5 can be counterclockwise rotated to move the slot 53 to a position right above the sucker 3. At this time, the sucker 3 bounds outward through the slot 53 by means of its own resilience for a user to suck the beverage. Reversely, when the rotary member 5 is clockwise rotated, the sucker 3 is biased by the upper wall of the rotary member 5 and retreated thereinto.

SUMMARY OF THE INVENTION

It is a primary object of the present invention to provide a a kettle having an upward bounding cover member and an automatically extensible sucker. This kettle has new structure and the cover member thereof is opened in an automatically upward bounding manner. This makes the operation of the kettle more easy and convenient. Moreover, the kettle is totally made of plastic material and free from any sharp metal component. Therefore, a little child who uses the kettle is protected from cut or abrasion and the safety in use is insured.

According to the above object, the kettle of the present invention includes a kettle body, a kettle cap screwed on an upper open end of the kettle body, a cover member disposed on the kettle cap to cover the same, and a sucker means inserted through a central hole of the kettle cap to communicate with inner chamber of the kettle body. One end of the kettle cap is disposed with a pivot support seat with which a resilient member is pivotally connected. A pressing board is fitted with the cover member. One end of the pressing board is engaged with the resilient member and the other end thereof is formed with an engaging hook section. The kettle cap is formed with a first depression corresponding to the engaging hook section. One lateral side wall of the first depression is formed with an engaging recess, whereby the engaging hook section is able to engage with the engaging recess, making the cover member associate with and cover a top surface of the kettle cap. At this time, the resilient member is resiliently bent and biased with a tendency to uplift the cover member. Meanwhile, the pressing board simultaneously presses and folds the sucker means to block inner flow passage thereof. A prying member is pivotally disposed in the first depression of the kettle cap. The prying member has a trigger section projecting from a front edge thereof and located under the hook section, whereby by means of pressing the prying member, the trigger section is able to move and separate the hook section from the engaging recess and by means of the resilient restoring force of the resilient member, the pressing board and cover member are automatically uplifted in a bounding manner.

The technical measures and functions of the present invention can be best understood through the following description of a preferred embodiment and accompanying drawings, wherein.

DETAILED DESCRIPTION OF THE PREFERRED EMBODIMENT

Figure 1:
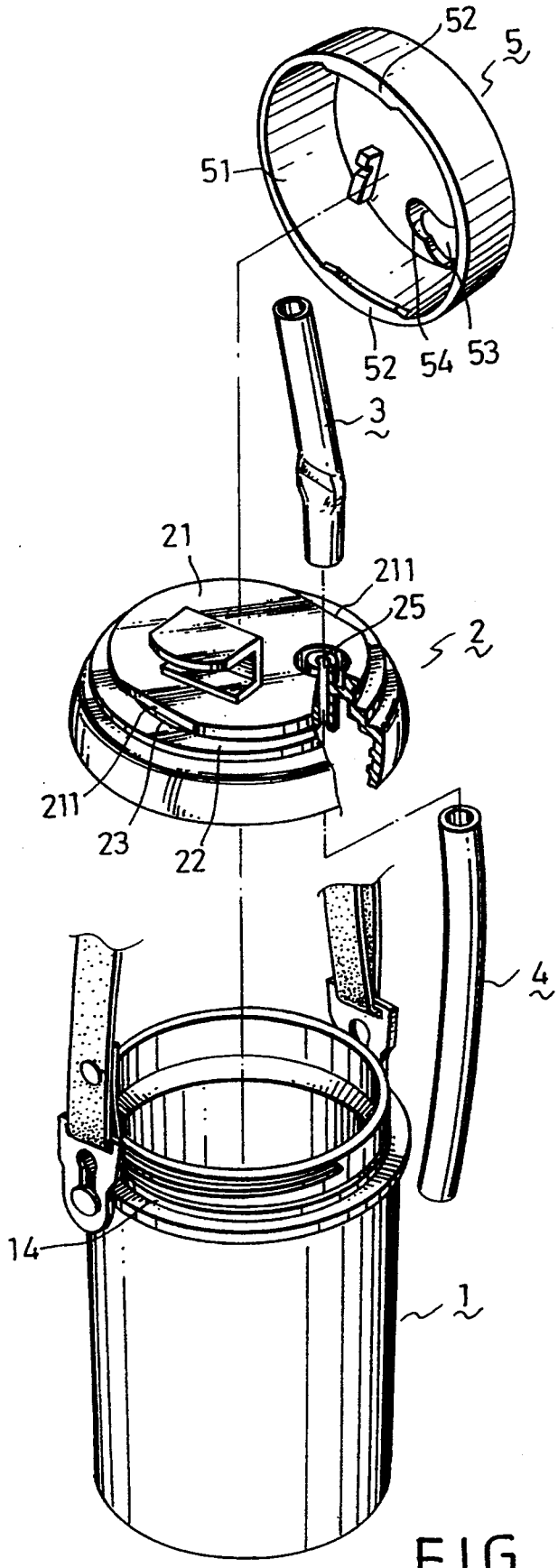
FIG. 1 PRIOR ART
FIG. 1 is a perspective exploded view of a prior art kettle.
Figure 2:
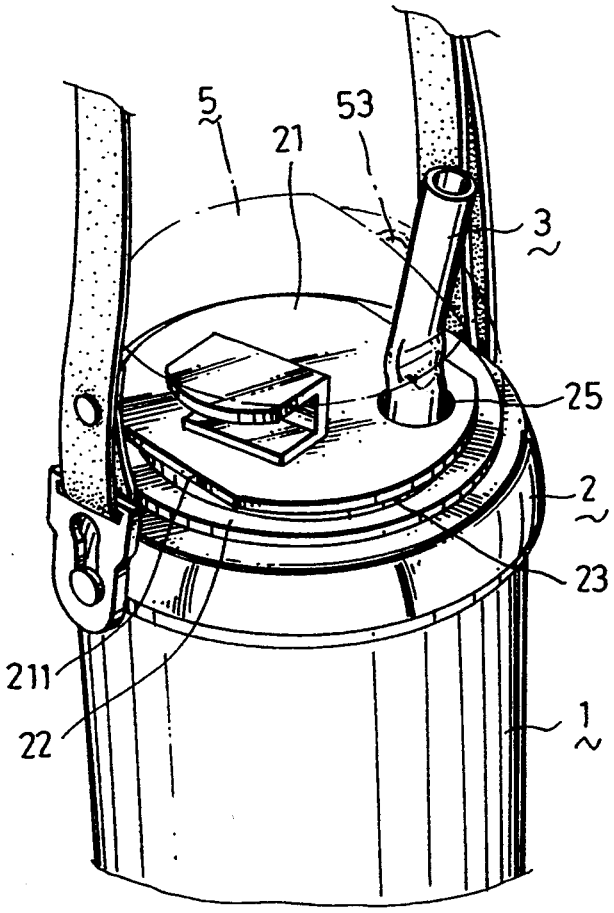
FIG. 2 PRIOR ART
FIG. 2 is a perspective assembled view according to FIG. 1.
Figure 3:
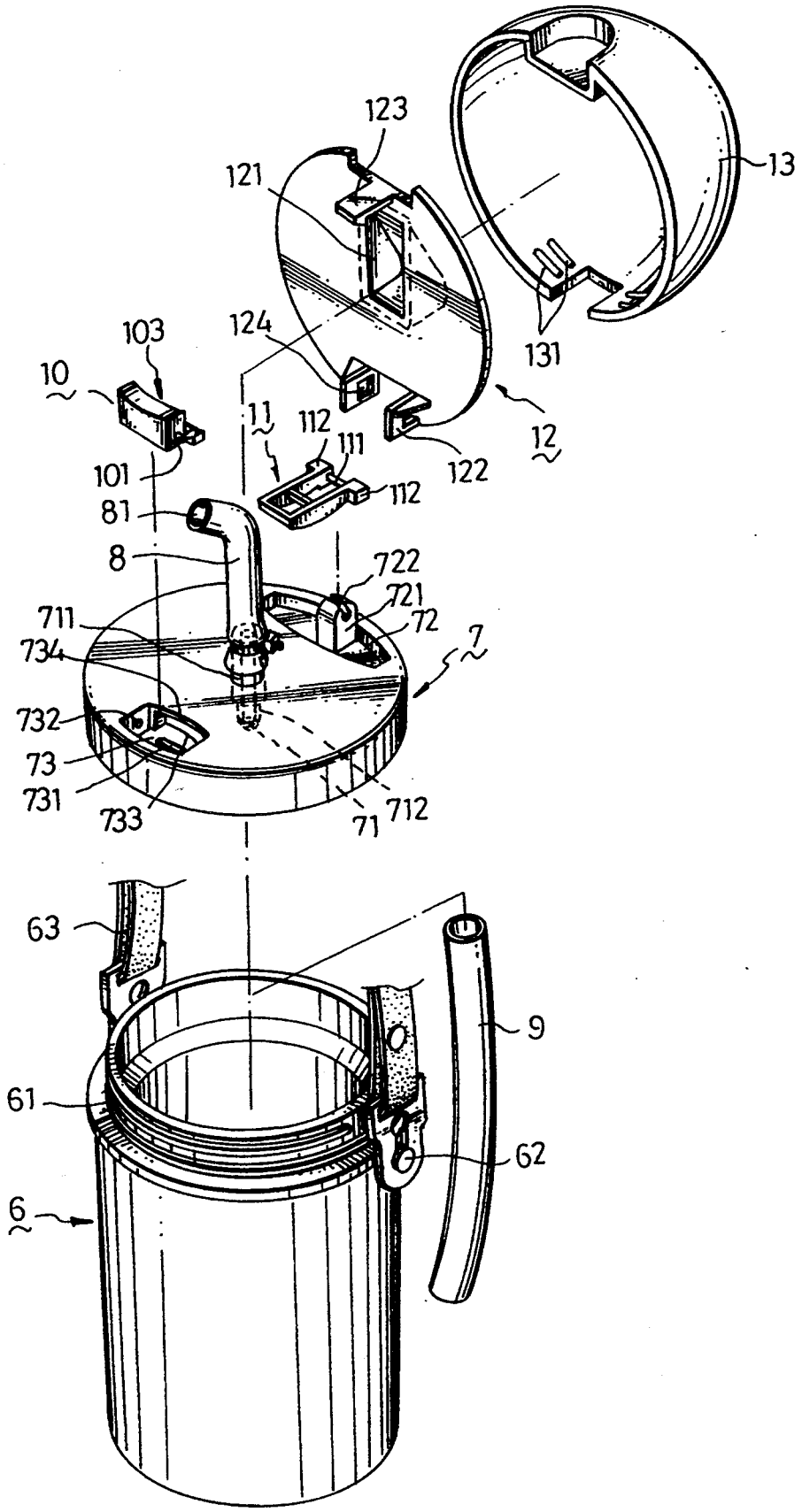
FIG. 3 is a perspective exploded view of the present invention.
Figure 4:
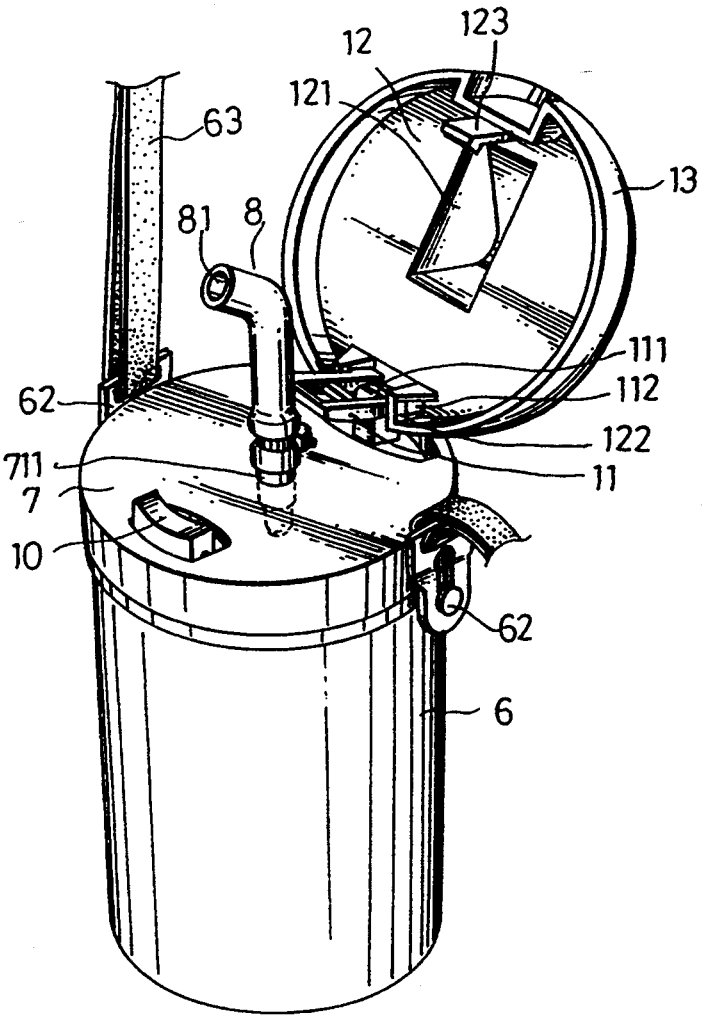
FIG. 4 is a perspective assembled view according to FIG. 3.

Referring to FIG. 3, the kettle of the present invention includes a kettle body 6, a kettle cap 7, a first and a second suckers 8, 9, a prying member 10, a resilient member 11, a pressing board 12 and a cover member 13, wherein all these components are made of plastic material except the suckers 8 and 9.

The kettle body 6 is a hollow cylindric member for containing beverage such as water, juice, etc. An upper open end of the kettle body 6 is formed with outer thread 61 and disposed with two lateral buckles 62 for fastening a back belt 63 thereto. For achieving a varying and attractive effect, the wall of the kettle body 6 can be designed with an inner and an outer layers (not shown) which define a closed annular chamber for containing a predetermined liquid and decorative suspending articles so as to attract attention of children.

The kettle cap 7 is screwed on the outer thread 61 of the kettle body 6 for sealing the kettle body 6. The kettle cap 7 is formed with a central through hole 71 and an upper fixing seat 711 and a lower fixing seat 712 which project respectively from an upper and a lower sides of the through hole 71. A substantially elliptic first depression 72 is formed on the kettle cap 7 beside the central through hole 71. A pivot support seat 721 having a top pivot recess 722 is disposed in the first depression 72. A second depression 73 is formed on the kettle cap 7 opposite to the first depression 72. A boss section 731 is formed on a bottom of the second depression 72 and two pivot shaft holes 732 are formed on two lateral side walls of the second depreesion 73. An engaging recess 733 is formed on an inner side wall of the second depression 73. The engaging recess 733 has a top wall formed with an arch lower edge 734.

The suckers 8, 9 are made of resilient material such as silicone and are respectively fitted on the upper and lower fixing seats 711, 712, whereby the beverage contained in the kettle body 6 can be sucked outward through the suckers 9, 8. The sucker 8 includes an inclined bent section 81 for facilitating the sucking movement.

Figure 8:
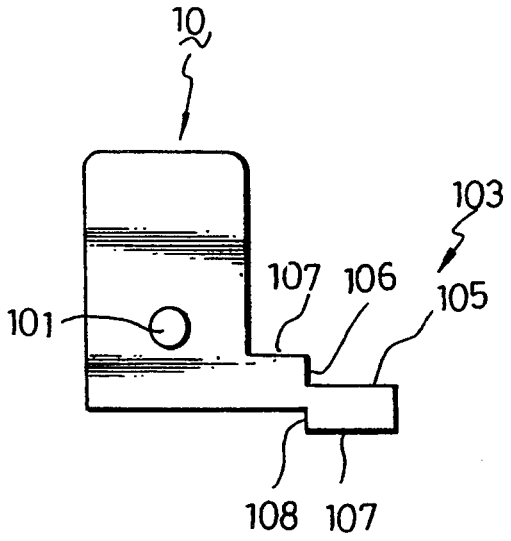
FIG. 8 is a side view of the prying member of the present invention.

The prying member 10 is substantially saddle-shaped and disposed in the second depression 73 on the boss section 731 thereof. The prying member 10 has two lateral pivot shafts 101 which are pivotally inserted into the pivot shaft holes 732 of the second depression 73, serving as a rotating center of the prying member 10, whereby the prying member 10 is able to swing about the pivot shafts 101. Please now refer to FIGS. 6 and 8. The prying member 10 has an integrally formed two-stage trigger section 103 which projects from a bottom of the prying member 10 toward the engaging recess 733. The trigger section 103 has a top side composed of a higher horizontal surface 104, a lower horizontal surface 105 and a vertical surface 106 connecting the two horizontal surfaces 104, 105, and a bottom side composed of a horizontal surface 107 and a vertical surface 108.

One end of the resilient member 11 is formed with a pivot shaft section 111 pivotally disposed on the pivot recess 722 of the pivot support seat 721 of the kettle cap 7, while the other end of the resilient member 11 biases against an upper surface of the kettle cap 7. Two ends of the pivot shaft section 111 is formed with rectangular projections 112. For saving material and enhancing resilience, the resilient member 11 is substantially like a ladder.

Figure 5:
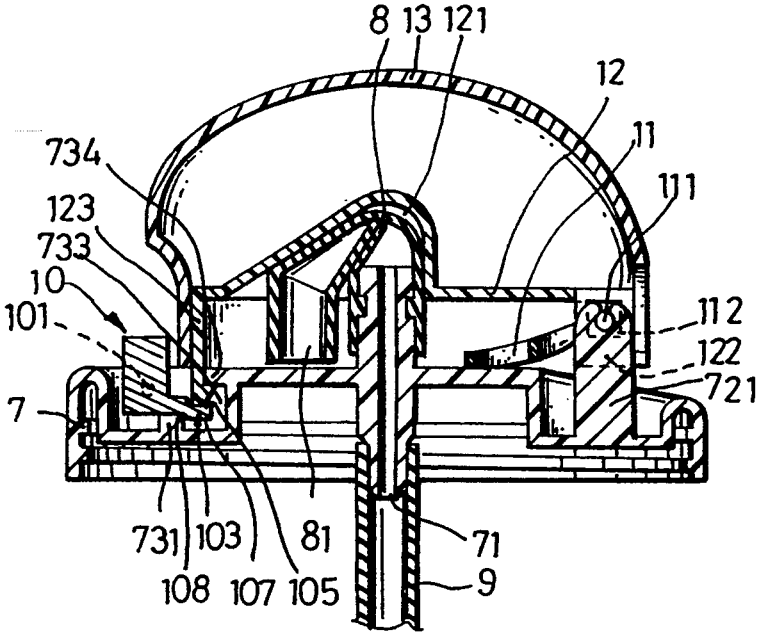
FIG. 5 is a sectional view of the present invention in a closed state thereof.

One end of the pressing board 12 is formed with two lug sections 122 having rectangular holes 124 for receiving the rectangular projections 112 of the resilient member 11. A central portion of the pressing board 12 is formed with a solid triangular recess 121. The other end of the pressing board 12 is disposed with an engaging hook section 123, whereby as shown in FIG. 5, when the pressing board 12 is pressed downward and rotated about the pivot support seat 721 to associate with the kettle cap 7, the engaging hook section 123 extends into the engaging recess 733 of the kettle cap 7 and engages with the top wall thereof. Simultaneously, the solid triangular recess 121 guides, folds and receives the sucker 8 and closes inner flow passage thereof. Also, the resilient member 11 is urged to bias against the top surface of the kettle cap 7 in a resiliently bent state. At this time, the hook section 123 is located above the trigger section 103 of the prying member 10 which is able to force and disengage the hook section 123 from the engaging recess 733.

Figure 6:
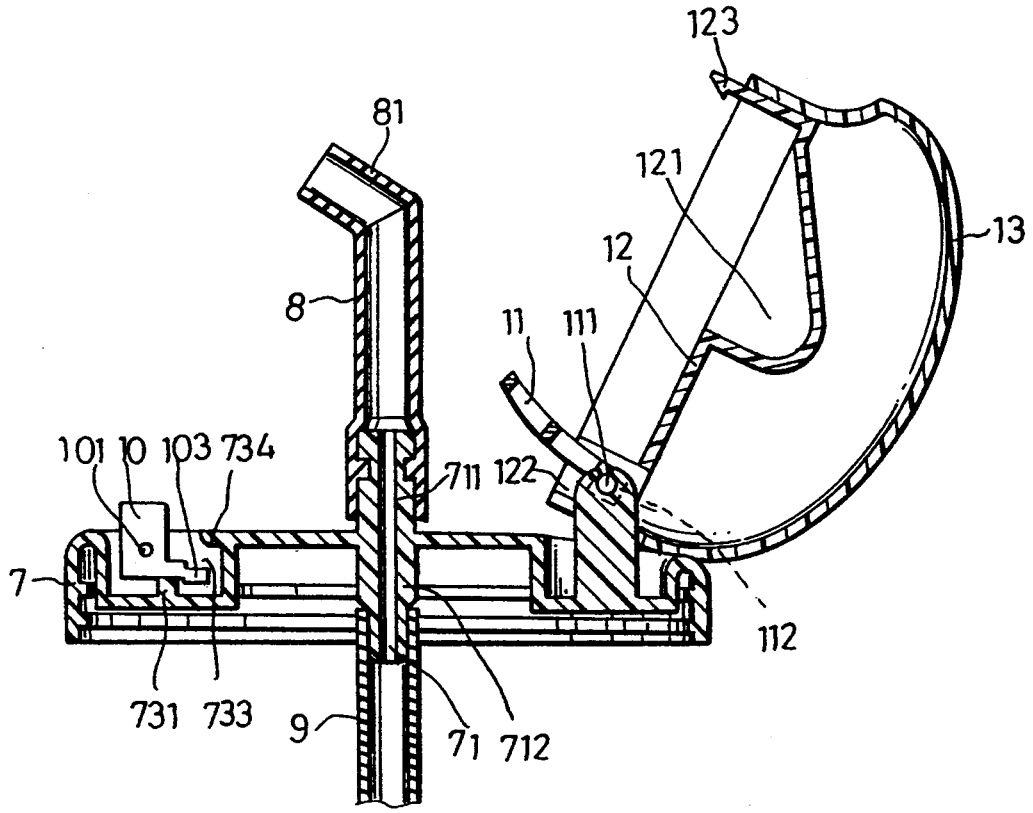
FIG. 6 is a sectional view of the present invention in an open state thereof.

The cover member 13 has a lower inner edge formed with two protruding stripes 131, whereby when the periphery of the pressing board 12 is secured between the two protruding stripes 131, the cover member 13 is associated with the pressing board 12. The cover member 13 serves to cover the kettle cap 7 and completely isolate the same from external environment for hygienic purpose. As shown in FIG. 6, the rearward swinging angle of the cover member 13 is limited by an upper edge of the first depression 72 of the kettle cap 7. The cover member 13 primarily functions to associate with and cover the pressing board 12 and can be variously shaped without limitation. For example, the cover member 13 can have a shape of an animal, a doll, etc. to attract a consumer to buy the kettle.

Please now refer to FIG. 5. The operation of the present invention is such that when closing the cover member 13, the hook section 123 is engaged with the top wall of the engaging recess 733 to lock the cover member 13 with the kettle cap 7 and keep a sealing state of the kettle for insuring hygiene. At this time, a lower end of the hook section 123 abuts against the top horizontal surface 105 of the trigger section 103 and the bottom vertical surface 108 abuts against the boss section 731 to control a forward inclined angle of the prying member 10. Also, the sucker 8 is guided and folded by the solid triangular recess 121 of the pressing board 12 and received therein for avoiding leakage of the beverage contained in the kettle body 6 (even when the kettle body 6 is turned over). In addition, the resilient member 11 disposed on the pivot support seat 721 is resiliently bent with a tendency to uplift the cover member 13.

Figure 7:
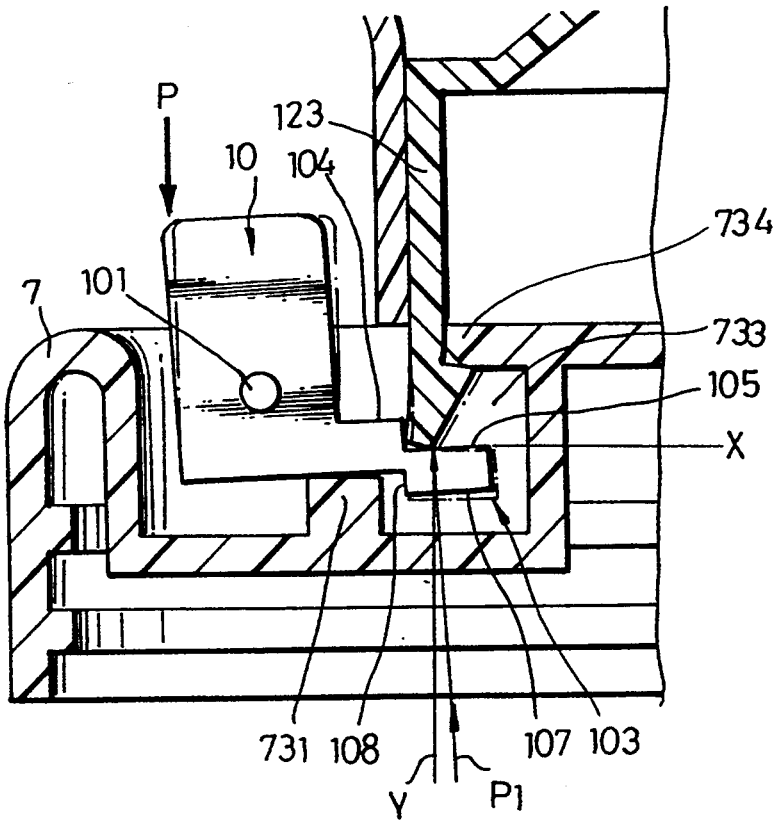
FIG. 7 shows the movement of the prying member of the present invention.

Please refer to FIG. 7. When a user wishes to drink the beverage contained in the kettle, the user only needs to exert a force P on the prying member 10 to obtain a force P1 at the contact position between the horizontal surface 105 of the trigger section 103 and the hook section 123 of the pressing board 12. The force P1 is divided into two component forces in X and Y directions, wherein the X component force transversely rearwardly moves the hook section 123, while the Y component force in cooperation with the guiding of the arch edge 734 of the engaging recess 733 urges the hook section 123 to separate from the engaging recess 733. Meanwhile, the resilient restoring force of the resilient member 11 acts on the cover member 13 and bounds the same upward away from the kettle cap 7 as shown in FIG. 6. Simultaneously, the sucker 8 is released from the bending force of the pressing board 12 and restores to a sucking position by means of its own resilience.

The kettle body 6, kettle cap 7, prying member 10, pressing board 12 and cover member 13 of the present invention are all made of plastic material, while the suckers 8, 9 are made of soft silicone. Therefore, these components are free from any sharp hard sections which may cut or abrade children and thus the safety of use is insured.

In conclusion, the kettle of the present invention is inventive in structure without any harmful sharp metal component for insuring safety in use. Moreover, the present kettle can be effectively closed and easily quickly opened.

The above preferred embodiment are only example of the present invention and the scope of the present invention should not be limited to the example. Any modification or variation derived from the example should fall within the scope of the present invention.

What is claimed is:

1. A kettle with an upward bounding cover and an automatically extensible sucker, comprising: a kettle body, a kettle cap screwed on an upper open end of said kettle body, a cover member disposed on said kettle cap to cover the same, and a sucker means inserted through a central hole of said kettle cap to communicate with an inner chamber of said kettle body, characterized in that one end of said kettle cap includes a pivot support seat onto which a resilient member is pivotally connected, and a pressing board fitted at a bottom end of said cover member, one end of said pressing board being engaged with one end of said resilient member, the other end of said pressing board being formed with an engaging hook section, said kettle cap being formed with a first depression corresponding to said engaging hook section, one lateral side wall of said first depression being formed with an engaging recess, whereby said engaging hook section is able to engage with said engaging recess, making said cover member associate with and cover a top surface of said kettle cap with said resilient member resiliently being bent and biased against said to surface of said kettle cap, and when said cover member associates with said kettle cap, said pressing board simultaneously presses and folds said sucker means to block flow therethrough, a prying member being pivotally disposed in said depression of said kettle cap, said prying member having a trigger section projecting from a front edge thereof, whereby by pressing said prying member, said trigger section is able to move and separate said engaging hook section from said engaging recess, and by the resilient restoring force of said resilient member, said pressing board and cover member are automatically uplifted in a bounding manner.

2. A kettle as claimed in claim 1, wherein said pivot support seat is disposed in a substantially elliptic second depression formed in said kettle cap.

3. A kettle as claimed in claim 1, wherein one end of said pressing board is formed with two lug sections each of which has a rectangular hole, and one end of said resilient member is formed with two rectangular projections suitable to be received in said rectangular holes.

4. A kettle as claimed in claim 1, wherein a central portion of said pressing board is formed with a triangular recess for pressing, folding and receiving said sucker means.

5. A kettle as claimed in claim 1, wherein a boss section is formed on a bottom of said first depression of said kettle cap under said prying member for limiting swinging angle of said cover member.

6. A kettle as claimed in claim 1, wherein said engaging recess has a top wall formed with an arched lower edge.

* * * * *